United States Patent [19]

Gerek et al.

[11] 4,025,664

[45] May 24, 1977

[54] CONTAINER COATING METHOD

[75] Inventors: Gene Gerek; Robert G. Coucher, both of Salt Lake City, Utah

[73] Assignee: EPPCO, Salt Lake City, Utah

[22] Filed: Nov. 25, 1974

[21] Appl. No.: 526,735

Related U.S. Application Data

[63] Continuation-in-part of Ser. Nos. 430,094, Jan. 2, 1974, Pat. No. 3,962,486, and Ser. No. 486,464, July 8, 1974, Pat. No. 3,947,617.

[52] U.S. Cl. ..... 427/183; 427/181; 427/195; 427/233; 427/240; 427/346; 427/425

[51] Int. Cl.[2] ..... B05D 7/22

[58] Field of Search ..... 427/181, 183, 195, 233, 427/240, 346, 425; 118/308, 312, 317, 315

[56] References Cited

UNITED STATES PATENTS

| | | | |
|---|---|---|---|
| 3,247,004 | 4/1966 | Dosser | 427/183 |
| 3,355,309 | 11/1967 | Bender et al. | 427/183 |
| 3,526,027 | 9/1970 | Manuel et al. | 427/195 X |
| 3,640,758 | 2/1972 | Hogstrom et al. | 427/233 |
| 3,697,313 | 10/1972 | Stumphauzer et al. | 427/233 |
| 3,745,035 | 7/1973 | Trohton et al. | 427/195 X |
| 3,804,663 | 4/1974 | Clark | 427/233 |
| 3,814,616 | 6/1974 | Kondo et al. | 427/183 X |
| 3,904,930 | 9/1975 | Waldron et al. | 317/3 |

*Primary Examiner*—Ronald H. Smith
*Assistant Examiner*—Shrive P. Beck
*Attorney, Agent, or Firm*—Trask & Britt

[57] ABSTRACT

A method for coating a cylindrical container with a thin, resinous coating by spraying powdered resin is disclosed. The technique involves spraying of finely divided resin particles at a velocity of at least about 200 feet per minute from a spray nozzle external to the container into the interior of a rapidly revolving container, particularly slender, cylindrical containers. The container may be sprayed by directing a pulse of a predetermined quantum of resin into the container to deposit a substantially uniform coating. Alternatively, a continuous flow of resin at a predetermined rate may be sprayed into a container. The resin particles are caused to adhere to the container by preheating the container. The coating is rendered continuous by preheating the container to temperatures above the softening point of the resin. Postheating of the coated container at temperatures in excess of about 300° F matures the coating.

27 Claims, 9 Drawing Figures

CONTAINER COATING METHOD

RELATED APPLICATIONS

This application is a continuation-in-part of copending application Ser. Nos. 430,094, filed Jan. 2, 1974 now U.S. Pat. No. 3,962,486, and 486,464, filed July 8, 1974 now U.S. Pat. No. 3,947,617.

BACKGROUND OF THE INVENTION

Small-mouthed containers, primarily of metal although some heavy duty paper containers are prevalent, are utilized for many purposes, most predominantly for commercial distribution of food and beverage — the ubiquitous "tin can". Although it is not a widely known fact, almost all "tin cans" used for food and beverage purposes are coated on the interior with a thin i.e., a thickness less than about 1 mil, comestible (food grade) resinous coating. About 60 million pounds of resin are utilized each year in coatings for food and beverage containers. These organic resinous coatings, which may vary in composition dependent upon the ingredient which they will contact, are necessary to prevent contamination of the food or beverage by the metal container, whether said container is tin plated steel or aluminum. Contamination of food and beverage by the metal container generally affects flavor, occasionally makes the food or beverage unwholesome, and frequently affects appearance. Also, the coating promotes the shelf life of the "canned" ingredients.

A number of different resinous compositions have been utilized with success as coatings for metallic containers, particularly food and beverage containers. Although water-based coatings have been available for a number of years, the films or coating resulting therefrom have not been satisfactory for food and beverage containers; for example, beer becomes turbid when stored for even short durations in metal containers coated with a water-based resinous coating.

The mainstay of the can coating industry has been organic, solvent-based coatings — in spite of the fact that the solvent, which evaporates upon application of the coating, is 80% of the weight of the material and often has a greater cost than the resin which remains on the container. Organic, solvent-based coatings have been successful, however, because thin coatings can be applied to metal containers which do not affect substantially the taste of the food or beverage. Solvent-based coatings, however, have a very distinct disadvantage — a very large quantity of solvent evaporates into the atmosphere adjacent container coating facilities. These organic solvents are generally noxious and frequently toxic.

One approach towards eliminating solvents from container coatings is to use 100% solids coating systems; e.g., the liquid styrene-polyester systems, epoxy resins and the like. Liquid systems containing 100% coatings solids; i.e., everything in the liquid system reacts or interacts to become an integral part of the resinous (polymeric) coating formed upon a substrate, have severe limitations in that few polymeric systems lend themselves to a liquid system wherein one of the reactants is dissolved in another reactant. Also, those 100% solids liquid systems available have such high viscosities that application by spray techniques is impracticable, if not impossible, especially when thin films are desired. A further limitation of 100% solids coatings for containers is the inclusion in the coating of a certain quantity of monomer or low molecular weight polymer which, even present as parts per million, produces odor and usually contributes taste to the coating.

Another type of 100% solids coating material is a powdered, resinous material. Powder coatings, as the term is commonly used, have been applied to objects primarily by fluid bed and electrostatic spray techniques. Fluid bed techniques are unsatisfactory to coat food and beverage containers since such technique coats both the interior and exterior, thereby consuming an uneconomical amount of resin. Also, coatings formed in a fluid bed tend to be relatively thick; e.g., 5 mils and greater. Electrostatic spray techniques work very well for most objects, although coatings less than one mil thick are difficult to obtain.

However, electrostatic spray principles (a charge on the powder and an opposite charge on the object to be coated) do not work when the interior of a small cylindrical metal container is to be coated. An effect known as the Faraday Cage Effect occurs when powder containing an electrostatic charge is propelled towards the interior of an oppositely charged metal cylindrical container having one end thereon, resulting in formation of a partial coating.

A further impediment to replacement of solvent-based coatings for containers, aside from the difficulties encountered in making very thin, pore-free films, has been the coating speed. Commercial container lines, particularly beverage container lines, move at a speed of 250 to 300 containers per minute.

DESCRIPTION OF THE DRAWINGS

The invention is illustrated by the attached figures wherein.

DESCRIPTION OF THE INVENTION

Figure 1:
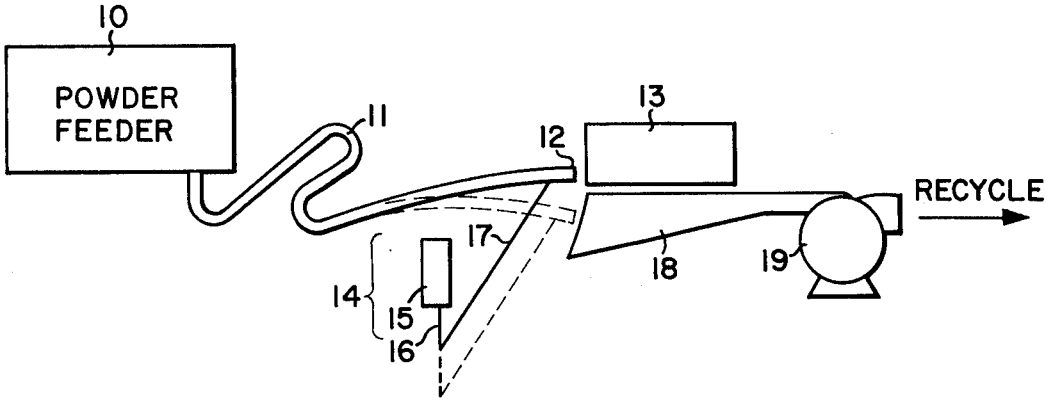
FIG. 1 is a schematic illustration of a continuous container coating apparatus.

A process has now been invented whereby an ultra-thin, substantially uniform resinous coating can be applied to the interior of a container, particularly a cylindrical, metal container having a length substantially greater than its diameter. Coatings may be readily applied at a thickness of less than 1 mil, and coatings having a thickness less than 0.5 mil and as thin as about 0.2 mil to about 0.05 mil and less having an electrical conductivity through the film of less than about 75 milliamps are feasible.

Coatings for containers, especially containers utilized in the food industry, have certain criteria which must be met, including thinness (for economic reason), inertness, impermeability, nonabsorptiveness and adherence. Coatings having these characteristics have traditionally been difficult to apply to two-piece containers. Solvent systems have been applied by a probe, although this technique is slow, having a maximum coating rate of 150 containers per minute. Solvent systems applied externally to the container tend to wash the coating off the dome of the closed end, frequently requiring an extra heavy coating on the closed end. Coatings meeting these criteria can be applied by the techniques of the instant invention.

The process by which ultra-thin coatings are obtained on the interiors of slender, cylindrical containers comprises generally:

a. preheating the container to a temperature in excess of the softening point of the resin particles, generally at least 150° F;
b. spraying into the interior of said container from a location outside of said container a predetermined quantum of finely divided resin particles, generally the particles are a thermoset resin having a softening point less than 150° F, sufficient to coat the container interior with a continuous film, said resin entrained in a gas stream traveling at a velocity sufficient to create substantial turbulence in said container; and
c. rotating said container rapidly for a period sufficient to cause said container to rotate at least two revolutions during the spraying of said particles.

The process works well with thermoplastic resin particles whereby the container is preheated to a temperature above the softening point of the resin which is generally above about 300° F for thermoplastic resins.

The various details of the process employed in achieving ultra-thin coatings on the interior of slender, cylindrical containers are now described.

Preheating

The cylindrical container is heated to a temperature in excess of the softening point of the resin to be applied, generally at least 225° F and preferably at least 300° F with useful temperatures ranging from about 150° F up to the metallurgical limits of the container, which depend upon wall thickness and construction material, e.g., a maximum temperature of about 525° F exists for the very thin walled aluminum containers typically used as beverage containers while temperatures of up to about 1000° F are safely used with steel walled containers.

Although a plasma arc generated flame is particularly useful for preheating slender, cylindrical containers other techniques of heating the container are useful. Hot air ovens, electric and gas ovens, electric resistance and combustion type flames can be utilized effectively to preheat the container.

Hot air ovens are generally available in most container coating plants since solvent coating techniques heretofore employed have required such ovens to drive off the solvent from the coating and to cure coatings of the thermosetting type. Such ovens typically have the ability to heat their contents to temperatures in excess of 450° F. Solid resin particles may be sprayed into containers immediately after the container leaves the oven or even in the oven through the use of a water-cooled spray nozzle. Spraying the container in the oven has the advantage of precluding any cooling of the container between the preheating and spraying stage and of providing heat to the container for curing or maturing the resin after spraying.

Electric resistance heating of the container may be practiced. A pair of electrodes are attached at opposite ends of a container to cause electricity to flow through the container, which acts as a resistor, thereby increasing in temperature.

Combustion type flames may also be utilized to heat the container. An oxyacetylene flame, for example, rapidly heats the container to temperatures in excess of the minimum coating temperature. Care must be exercised in operating the oxyacetylene torch to avoid operating either a strongly reducing or strongly oxidizing flame.

The preheating is preferably conducted so that the container is substantially uniformly heated, i.e., so that the whole container is at substantially the same temperature. A uniform container temperature aids the particles in adhering uniformly and in causing the film to mature uniformly. Furthermore, uniform heating is desired to avoid hot-spots exceeding the metallurgical limits of the container when the container is heated to temperatures near the upper metallurgical limits of the container.

The cooling rate of the container can be slowed by several techniques, for example, the ambient temperature can be raised, thereby providing a smaller $\Delta T$. The ambient temperature can be raised by placing the sprayed container in an insulated chamber having a temperature above the usual ambient. An insulated chamber having a temperature of 225° F to 300° F slows the cooling rate of a container preheated to 425° F to cause the coating therein to fully cure by the time the temperature of the container has dropped to about 225° F to 300° F. Alternatively, the temperature of the container may be maintained sufficiently high, e.g., above about 350° F for a period sufficient to cause the coating to cure by heating the container very briefly to a temperature of about 400° F to about 425° F, within a short time, e.g., 50 to 500 milliseconds after the container is sprayed. For example, the container, after being sprayed, can be heated to about 425° F in about 100 milliseconds, or less, by a plasma arc generated flame.

In practice, the degree to which cooling is retarded depends upon the coating being applied. Typical thermoset resinous coatings require exposure for a limited period of time at a temperature at or above the curing temperature of the resin. Typical epoxy resins useful in coating containers, e.g., Epon 1004, require a residence time of about one to three minutes at a temperature of about 350° F to effect curing of the coating. At temperatures above the minimum curing temperature, the curing proceeds more rapidly, but a minimum period of about one minute is required. Heating the coated container to temperatures substantially in excess of the minimum curing temperature insures that a temperature at least equal to the curing temperature will be experienced for a period sufficient to cause the coating to cure.

Thermosetting resins are generally low molecular weight polymers which cure by cross-linking to form a very high molecular weight polymer. The viscosity of a thermoset resin decreases as temperature increases until gellation occurs; thereafter, viscosity increases as temperature increases. The melt viscosity of a typical thermosettable resin useful as a coating material, e.g., Epon 1004, is illustrated in FIG. 5.

At point A the resin is at its softening point. As the temperature increases, the resin viscosity decreases until the lowest melt viscosity is achieved at point B. With further increase in temperature, viscosity increases until gellation occurs, thus point C is the gel point of the resin. After gellation occurs, the resin cannot be reflowed, i.e., the particular shaped or physical condition of the resin cannot thereafter be altered by any means without destroying the integrity of the resin.

Figure 5:
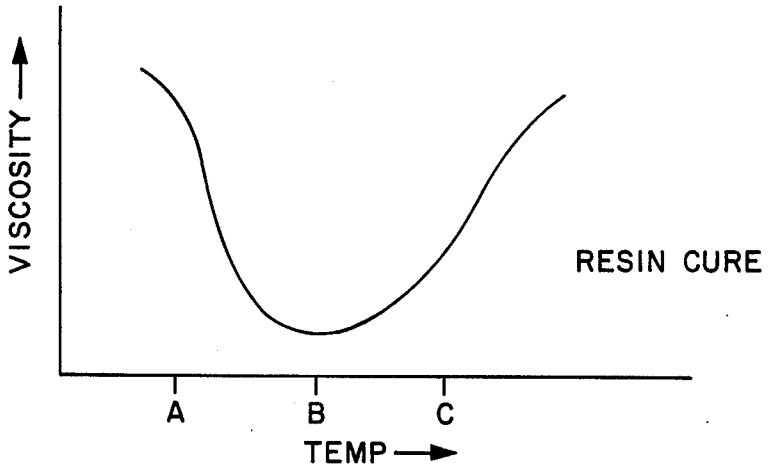
FIG. 5 graphically represents the relationship between viscosity and temperature of a typical thermoset resin.

In utilizing thermosetting resins in the instant invention, it is required to apply the resin particles to a container having a temperature above the softening point of the resin and preferably above point B on the viscosity curve, FIG. 5, i.e., above the temperature at which the resin is least viscous so that optimum flow of the resin particles into an impervious, continuous film is achieved. Film uniformity is enhanced by spraying the resinous particles into a container which is at or near the lowest melt viscosity temperature of the resin. At a temperature of 350° F, for example, a typical epoxy resin such as Epon 1004 (plus dicyanamide catalyst) adheres and gels within 50 milliseconds. Epon 1004 is a propriatory polymer of Shell Chemical Company, Houston, Tex.

Applying the resin particles at temperatures above the gel point is also preferred inasmuch as the resin particles will flow into an impervious, continuous film and gel in such a state so that very little additional energy is required to cure the resin to a full cured state having maximum properties as a protective film. If the temperature of the container is sufficiently above the gel point to provide thermal energy to the coating to raise it to the gel point without having the temperature of the system drop below the gel point, gellation of the resin will occur. After gellation is initiated, if the thermal energy possessed by the container is sufficient to maintain the temperature of the coating above the gel point for at least 1 minute and preferably for about 3 minutes, unless a very fast curing resin is utilized, the coating will become fully cured.

It is apparent that the technique of imparting a substantial amount of thermal energy required to gel the thermosetting resinous coating, or even to bring about full cure by preheating the conainer to elevated temperatures, is significant sine only one energy input station is required, or at least if a second energy input station is required, only a small amount of energy need be imparted at such second station. A second advantage, of course, to having the resin gelled, or even cured, shortly after spraying it that the coating is durable and cannot be dislodged in the manner of an electrostatic coating which adheres merely as electrostatically charged particles until passes through an oven or other device to impart a substantial amount of thermal energy thereto.

Thin walled containers, especially aluminum containers, lose heat rapidly, e.g., at 450° F a thin walled aluminum container drops approximately 300° F in about 4 seconds. Thus, it is necessary to spray a container promptly after preheating to avoid an undue energy loss and perhaps even have the substrate temperature lower than the minimum to achieve an adherent coating. Also, it is preferred to insulate the container after spraying to preserve the thermal energy present in the container.

The techniques described herein for application of a thermosetting resinous coating are useful also for applying thermoplastic resinous coatings although the behavior of the resin may be different. A thermoplastic resin decreases in viscosity as temperature increases, thus, generally, the flowability of the resin improves as temperature increases. Therefore, thermoplastic resins must be selected which have good coating protective properties at the temperature of use but have sufficiently low flow point to be practicably applied. Higher minimum preheat temperatures, e.g., generally above 400° F, are required to achieve good thermoplastic films in contrast to the lower temperatures useful for thermoset resins. Typical thermoplastic resins include nylon, thermoplastic epoxide and phenoxide resins having molecular weights of about 20,000 to about 200,000, polypropylene, polyethylene and the like.

The technique of providing sufficient thermal energy in the container to cause the resin particles to adhere and form a continuous film on a can works best when very thin films are applied, i.e., films less than about 0.5 mil thick, so that the quantity of thermal energy to raise the coating to the curing temperatue and to initiate curing is not greater than the energy present in the container.

Rotation of Container

As illustrated in FIG. 1, a slender, cylindrical, two-piece container is sprayed with finely divided resin particles while being rotated. Although various rotational speeds are effective, the minimum rotational speed preferred is one sufficient to create a vortex within the container. Although this may vary depending upon the diameter of the container, for the common container designed to hold 12 fluid ounces, which has a diameter of about 2½ inches, a minimum rotational speed of about 500 rpm is desired and a rotational speed of above about 700 rpm is preferred. Rotational speeds up to 5000 rpm may be used.

Best coating results are achieved when the rotational speed is from about 1000 rpm to about 2500 rpm. Since it is an objective of the instant invention to provide ultra-thin coatings for container interiors which will meet the standard of the beverage industry, the coatings should have a substantially uniform thickness. Otherwise, areas which have insufficient coating thereon will fail.

Figure 6:
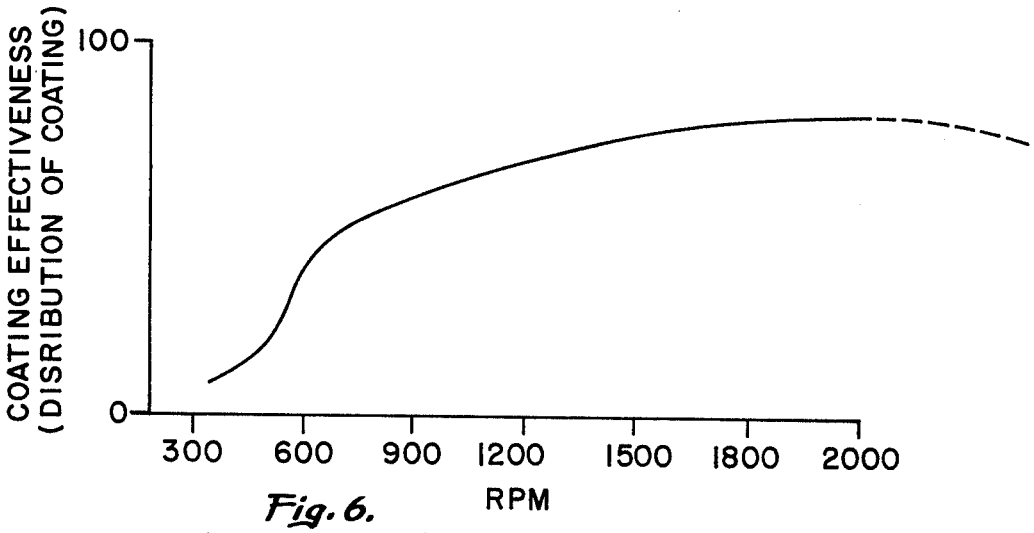
FIG. 6 graphically represents the relationship between coating effectiveness and the rate of revolution of a container being coated.

Coating distribution, i.e., uniformity of film thickness, can be altered by varying the rotational velocity of the container being sprayed. As illustrated in FIG. 6, the uniformity of the coating increased with increasing rotational velocity for a given set of spray conditions.

The rotational velocity of the container and the spraying conditions, i.e., spray duration, are interrelated inasmuch as a minimum of two revolutions during the period the resin is being sprayed appears to give best results. Thus, for a resin spray duration of about 100 milliseconds, a minimum rotational velocity of about 1200 rpm is preferred.

Figure 3:
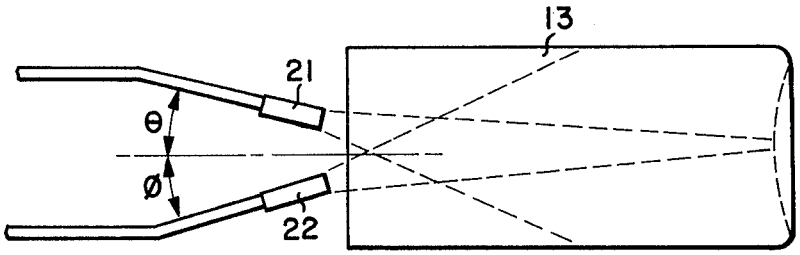
FIG. 3 illustrates a typical spray pattern for a dual nozzle container coating system.

Although rotation of the container at a speed sufficient to create a vortex aids in achieving good weight (or thickness) distribution of the resin, it creates problems in achieving a good coating on the bottom of containers having a domed bottom, which exist on substantially all thin walled, lightweight aluminum beverage containers. A container with a domed bottom is illustrated in FIG. 3. Rapid rotation of a container with a domed bottom tends to throw the coating off the dome. A certain minimum particle velocity is required to cause sufficient particles to reach the outer perimeter of the central dome area.

Pulse Spraying

A preferred technique for coatin slender, cylindrical containers with ultra-thin, high quality coatings is by pulsing predetermined quanta of resin intermittently into the containers. A container is preheated and rotated in the manner described elsewhere herein, then a single pulse or multiple pulses of a resin/gas mixture are introduced into the container from a nozzle near the open mouth of the container. The velocity and volume of the gas/resin mixture is preferably sufficiently great so as to cause turbulence within the container, but preferably not so great as to cause substantial cooling of the container.

Figure 2:
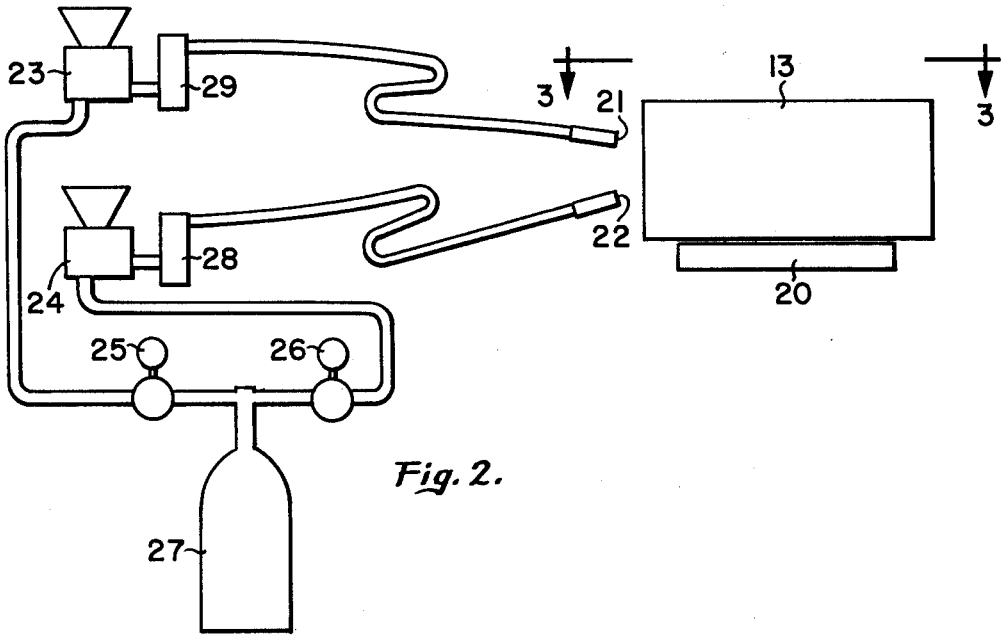
FIG. 2 schematically illustrates a pulse coating system utilizing two spray nozzles.

The technique of pulsing resin particles into a preheated, rapidly rotating container is illustrated by FIGS. 2 and 3. In FIG. 2 a slender, cylindrical container 13, generally one which has a diameter less than about 3 inches and a length to diameter ratio of about 2:1, is shown resting on a cradle 20 which can spin the container about its longitudinal axis at rates of from 500 rpm to 2500 rpm or higher. A pair of spray nozzles, nozzle No. 1, 21, and Nozzle No. 2, 22, are positioned in close proximity to the open end of the container, e.g., the nozzles are usually within 0.03 to 0.5 inches from the plane which contains the rim of the container opening.

The nozzles are connected by thin tubing to a pair of pulsing devices, 23 and 24, which are connected through a pair of pressure control valves 25 and 26 to a source of high pressure gas 27. The spray system is illustrated in its preferred form, i.e., a pair of spray nozzles are used. Acceptable coatings are obtainable through use of a single nozzle, but coatings having a more uniform distribution over the whole container have been obtained through use of two or more nozzles. Also, a lower film weight film with good characteristics is obtained through use of multiple nozzles.

The pulse devices utilized are preferably of the type described in copending application Ser. No. 492,498 filed Jan. 29, 1974, the description therein incorporated herein by reference. Also useful are pulsators of the type described in copening application Ser. No. 430,721 filed Jan. 4, 1974. The preferred pulsator admits a certain quantum of resin into a chamber, surge of high pressure gas then propels the resin from the chamber to the spray nozzles.

In FIG. 2 a pair of mixing or surge chambers 28 and 29 are illustrated. Although pulses of resin can be directly conveyed from the pulsators to the spray nozzles, the resin frequently did not intermix thoroughly with the gas, thereby exiting the spray nozzle as a surge of resin particles over a short duration, followed by the bulk of the gas. It was found that a pulse of 150 milliseconds frequently comprised a resin pulse of 15 to 30 milliseconds followed by a gas pulse of 120 to 135 milliseconds. The resin surge, of course, contained some gas intermixed therewith, but the resin pulse was undesirably short because an objective of spraying with fine resin particles is to get good distribution of particles within the container and preferably for a minimum period of two revolutions of the container. A rotational speed of about 4000 rpm is required to provide two revolutions during a 30 millisecond resin pulse, which speed is feasible but generally rotational speeds in excess of 2000 to 2500 rpm are not practicable on presently available commercial equipment for rotating slender, cylindrical containers.

The surge chambers 28 and 29, with internal baffling to preclude channeling, provide means for admixing the resin particles with more of the carrier gas and extending the duration of the resin spraying portion of a 150 millisecond pulse, for example, to 60 to 120 milliseconds. A rotational speed of about 2000 rpm provides two container revolutions during a 60 millisecond pulse of resin.

The gas/resin mixture exiting from the spray nozzles must possess a certain minimum velocity in order to travel sufficiently far into the container to coat the whole of the container, or at least that portion of the container which a single nozzle in a multi-nozzle arrangement is expected to coat. In applying thin coatings, as dintinguished from ultra-thin coatings, resin or carrier gas velocities of at least 200 feet per minute can be utilized, for example, to form films of about 0.5 mil or greater which are acceptable coatings. In order to achieve ultra-thin coatings with good resin distribution, a minimum velocity of about 500 feet per minute is required and a velocity in excess of about 5,000 feet per minute is preferred. The velocity referred to is the average velocity of the particles immediately after leaving the spray nozzle for the first few inches of travel.

This "average velocity" is difficult to determine with precision, but for purposes of this disclosure is regarded as the velocity of the front wave of the powder exiting a nozzle, as determined by high speed photographic techniques. It is recognized that the true speeds of individual particles may be considerably greater or less than the average velocities referred to herein. Moreover, it is recognized that the velocities of the particles reduce very quickly as they travel away from the nozzle. Nevertheless, the average velocity, as thus measured, constitutes a useful parameter for process control.

Although the precise phenomena involved may not be perfectly understood, it is known that a barrier of static air persists adjacent the interior surface of the container. It is also known that the resin/gas mixture is deflected by the interior surface (or more accurately, by this "static barrier") so that the resin particles tend to be carried out of the container without impacting against the interior surface of the container unless their individual momentums are sufficient to carry them through the barrier. Increasing the average velocity of the particles is believed to increase the probability of particle penetration of the barrier in two ways. First, the individual momentum of each particle is, on the average, increased. Second, the increased gas velocity associated with the increased average velocity of the particles tends to cause increased turbulence within the container, thereby imparting random directional components to the velocity vectors of individual particles. These factors are especially significant in the case of smaller and/or lighter particles. The minimum acceptable average particle velocity in any given instance will be influenced by such factors as the thickness of the static air barrier; the density, average particles size, particle size distribution and other properties of the resin used; and the location of the spray nozzle with respect to the can to be coated.

Figure 4:
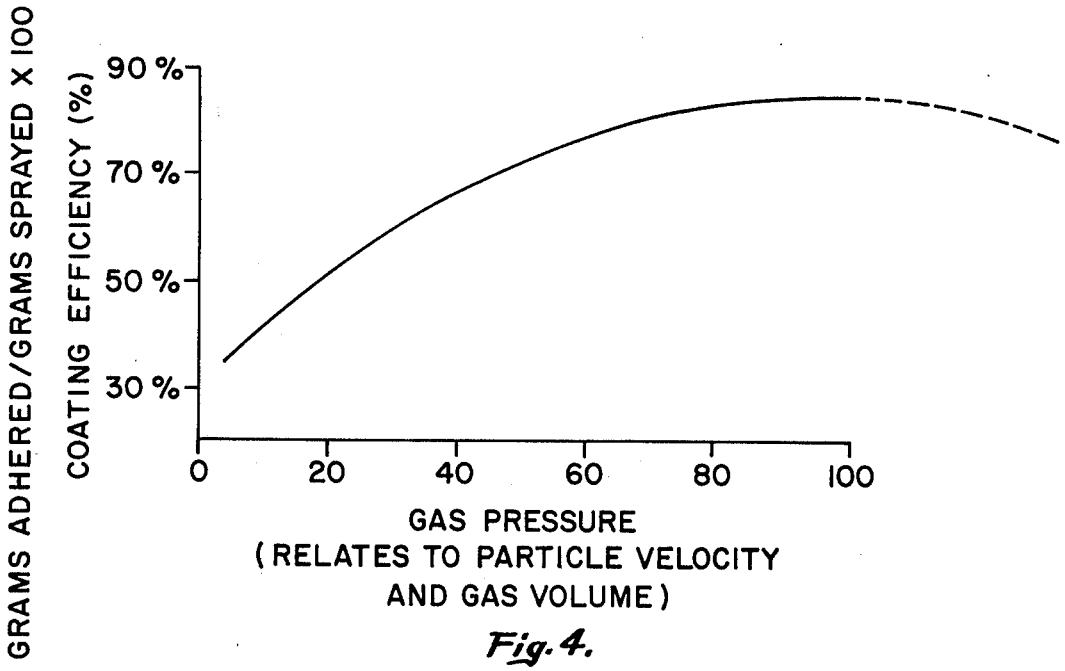
FIG. 4 graphically represents the relationship between coating efficiency and the pressure of a pulse of a gas/resin mixture.

The effect of particle velocity and gas volume upon coating effectiveness has been determined from spraying containers rotated at about 1800 rpm through the use of the system of FIG. 2 wherein the carrier gas was under various pressures when released to the pulsator. FIG. 4 illustrates the effect of increasing particle velocity and increasing carrier gas volume. Coating effectiveness is defined as the percentage of coating deposited upon the container interior as a function of the amount of resin introduced into the container. The difference between the Coating Effectiveness percentage and 100% is the percent of "overspray", i.e., resin which did not adhere to the container interior.

As illustrated in FIG. 4, the coating effectiveness increased from a value of about 30 percent at 10 psi gauge to about 90% at about 100 psi gauge. The volume of gas and velocity of particles at 100 psi gauge is about ten fold the volume and velocity at 10 psi gauge.

The system utilized to obtain the data for FIG. 4 was similar to that illustrated in FIG. 2 wherein a certain static air pressure was applied to the system, which had a constant volume. Upon release of a pulse of resin, the air pressure propelled the resin through the tubing and spray nozzles. Since the volume of the system was constant, the velocity was proportional to the square root of the pressure. Thus, increasing the pressure by a factor of four approximately doubled the velocity. Although exact upper limits have not been determined, gas/resin velocities of about 2000 to about 12,000 feet per minute produce excellent results. It is believed that much higher velocities, e.g., supersonic velocities, are practical and will enhance penetration of the static air barrier adjacent the inner surface of the container by smaller resin particles.

A uniform quantity of resin is discharged in each instance in FIG. 4 since the volume or weight of resin is predetermined. Also, the total pulse duration of the carrier gas is constant regardless of the gas pressure. The duration for spraying of resin particles is preferred to be from about 30 milliseconds to about 150 milliseconds. The total gas pulse may be longer, e.g., from about 10% to about 100%, than the period when a substantial resin/gas mixture is exiting from the spray nozzles.

The quantity of resin which exits from a single nozzle during a single pulse can be regulated from about 25 milligrams to about 1000 milligrams. A typical slender cylinder beverage container capable of holding 12 fluid ounces has an interior area of about 43 square inches. Thus, to coat the container with a 0.5 mil film (approx. 10 mgs/square inch), a total of about 430 milligrams is required. Unless the coating effectiveness is 100%, more than 430 milligrams of resin has to be sprayed into the container to achieve a total film weight of 430 milligrams. A single nozzle spray can achieve acceptable films at average thicknesses of about 0.5 mil (approximately 10 mgs/square inch) or greater. At these average film thicknesses, the coating has properties acceptable for a beverage container.

The preferred technique for coating container interiors with ultra-thin films has involved a multiple spray nozzle arrangement. As illustrated in FIGS. 2 and 3, a pair of nozzles 21 and 22 are directed into the container. Neither nozzle should be aligned on the central longitudinal axis of the container. If any nozzle lies on the central longitudinal axis, it should be aligned at at least a slight angle to said axis. This is preferred whether single or multiple nozzles are used in the spraying operation. A particularly preferred arrangement is to have no nozzle on the central longitudinal axis of the container and to have all nozzles disposed at a slight angle between about 2° and 30° to said axis. In locating each of a pair of nozzles, it is preferred to locate one nozzle, e.g., nozzle 21, so that its spray is directed towards the side wall of the container and the second nozzle, e.g., nozzle 22, directed at the juncture of the side wall and base of the container. Neither nozzle is required to emit a spray which covers a large area, it being sufficient if the spray area is a few square inches because the turbulence within the container distributes the resin particles over the container interior.

It is preferred generally to discharge the pulsators simultaneously when multiple nozzles are utilized. In some instances, however, sequential discharges are used. For example, in FIGS. 2 and 3 one useful sequence is to discharge nozzle 21 and then discharge nozzle 22 a few milliseconds later, preferably either before or after the container has made about one-half of a revolution. When using a pair of nozzles, approximately one-half of the resin particles to be introduced into the container is ejected from each nozzle. The ratio may be varied, however, with the ratio varying from about 10:1 to 1:1, depending upon the function to be performed by a particular nozzle.

Utilizing the system illustrated in FIGS. 2 and 3, containers with ultra-thin coatings thereon, e.g., 0.2 mil and less, have been sprayed. Achievement of films of this weight is dramatic inasmuch as powder coatings had been previously utilized generally only for the purpose of obtaining thicker films and that the attainment of thin films on container interiors had not been achievable by powder coating techniques. Heretofore, thin films, i.e., films less than about 0.3 mil, had not been attainable directly from a coating material, i.e., a 100% solids system. In a solvent system, the achievement of a 0.3 mil film resulted only from the application of a resin-solvent film perhaps 0.6 to 1.0 mil in thickness, which, upon evaporation of the solvent, left a resin film of about 0.3 mil. Electrostatically applied coatings have not been practicable for container interiors because of the Faraday Cage effect, but even application of electrostatically charged particles to a substrate does not result in such ultra-thin films, even after postheating, and the attainment of a very adherent, substantially instantaneous continuous film, as compared to a continuous layer of discrete particles, has never been achievable with an electrostatic spray system.

Continuous Spraying

A container, particularly a slender, cylindrical container, may be coated with a thin, uniform, comestible, organic coating by pneumatically conveying finely divided resinous particles from a powder feeding device to a spraying device at a substantially constant rate which may be varied from about 1 gram per minute to about 150 grams per minute.

A discrete quantum of resinous powder is sprayed into the interior of a preheated container at a velocity sufficient to create substantial turbulence within the container. The particles may be a liquid resin, although more typically are finely divided solid particles having a softening point lower than the temperature of the preheated container. The solid particles become high viscosity liquid upon contact with a container preheated to a temperature in the lower region of the preheat temperatures and adhere to it. The container can then be heated to cause the coating adhered thereto to form a continuous, uniform film of resin on the container interior. At elevated preheat temperatures, the resin particles become a high viscosity liquid upon contact with the substrate. It is feasible to greatly reduce and even eliminate postheating by preheating the container to high temperatures; e.g., about 400° F and higher.

The resinous material may be continuously fed through the spraying device or it may be fed in pulses of discrete quanta. The resin is caused to adhere to the container by preheating the container to a temperature above the point where the resin becomes liquid. The container is preferably revolved about its longitudinal, central axis, preferably for at least two revolutions per resin pulse.

The device illustrated in FIG. 1 is an apparatus for continuously coating containers through use of a continuous supply of powdered resin. Powder feeder 10 is of the type described in copending application Ser. No. 223,969, filed Feb. 7, 1972, which supplies a substantially uniform rate of resin feed at a rate which may be varied from about 1 gram per minute to about 150 grams per minute. Typical resin feed rates are from about 5 grams per minute to about 100 grams per minute. Regardless of the feed rate selected, it is particularly important that the resin feed rate be substantially uniform inasmuch as each container to be coated will be exposed to the resin spray for the same period of time which, therefore, requires a uniform rate of feed if each container is to receive substantially the same quantity of resin. It is necessary that the containers receive the same quantity of resin inasmuch as the films to be deposited are very thin and any substantial variation in the resin feed rate will result in one container having a thick film and another container having a film which is too thin to perform its function. Film coatings with thicknesses of less than 1 mil and preferably less than about 0.5 mil and as low as about 0.2 to 0.05 mil are preferred thicknesses for container coatings. Since thicknesses less than 1 mil are difficult to measure, the film thickness is often expressed in weight terms, e.g., milligrams per square inch. A film 1 mil thick has an approximate weight of about 20 milligrams per square inch. Thus, a film weighing 4 milligrams per square inch has a thickness of approximately 0.2 mil.

Typical container coating rates are from about 60 containers per minute to about 600 containers per minute with a typical commercial rate being about 250 to about 350 containers per minute. Thus, at a coating thickness of 0.5 mil for a container having about 43 square inches of interior surface, a total of about 430 milligrams of resin is required. A coating rate of about 60 such containers per minute requires a resin feed rate of 25,800 milligrams per minute or about 26 grams per minute.

The thin coatings must be continuous and possess sufficient film integrity to protect the container from its ingredients and vice versa. The integrity of the film is determined by testing the electrical conductivity of the film. An arbitrary standard has been developed which requires a film to possess a film conductivity no greater than 75 milliamps.

Electrical conductivity is, of course, affected by the thickness of the film. For example, a film having a uniform thickness of 0.2 mil may possess an electrical conductivity of 40 milliamps, while a film having the same average thickness but possessing peaks and valleys wherein the valleys comprise 50 percent or more of the film area and have a thickness of perhaps only 0.05 mil, or even possessing pores wherein no coating covers certain portions of the substrate, may possess an electrical conductivity of 80 milliamps or more. Since a coating with a uniform thickness throughout the whole coating is difficult to achieve, it is especially important to place a minimum thickness of coating on each portion of the container. For example, if it is determined that a certain coating composition applied by certain technique provides an acceptable electroconductivity at a film thickness of 0.2 mil, it is necessary that each container be coated wherein only a small percentage of the surface area has a film thickness less than 0.2 mil.

the powder feeder 10 feeds fine particles of a thermoplastic or thermoset resin having a particle size range of about 1 micron to about 100 microns. A preferred average particle diameter is about 10 microns or smaller. The particles are delivered to a tube 11 which preferably has a diameter of about 0.1 to about 0.5 inches. The powder feeder discharges resin into the tube at a predetermined feed rate which is substantially uniform although there may exist a deviation of about 10 percent at any given moment. Inert gas is introduced into the powder feeder at a rate of about 1 curbic foot per hour to about 50 cubic feet per hour to convey powder through tube 11 at a velocity sufficient to eject the powder/gas mixture from a nozzle at a velocity of above about 200 feet per minute, preferably above about 2000 feet per minute. It is generally preferred that the discharge velocity of the resin/gas mixture from the spray nozzle 12 be sufficient to cause substantial turbulence in the container. The preferred higher resin velocities, i.e., 2000 to 12,000 or more feet per minute, are more easily achieved by pulse spraying techniques.

The spray nozzle 12 preferably has a diameter no larger than the interior diameter of tube 11 and in many instances the outlet diameter of the nozzle is substantially smaller than the tube diameter so that the velocity of the resin through the nozzle is increased. Nozzle outlet diameters are frequently in the range of about 0.200 to about 0.400 and preferably about 0.238 to about 0.312 inches. Nozzle 12 is preferably closely adjacent to the open mouth of a container, said container having one closed end, which may be a simulated closed end, and one open end.

It is generally preferred that the resin be conveyed with a minimum amount of gas so that the least cooling effect possible is experienced by the preheated container. This is especially necessary when the temperature of the preheated container is only 225° F to about 250° F.

Container 13 is introduced to a position directly in front of nozzle 12 at a rate of about one per second to about 10 per second. A continuous supply of resin at a predetermined rate is discharged from nozzle 12 into container 13 for a predetermined period of time, which is usually less than the residence time of container 13 in a spraying position. For example, containers being introduced to position before nozzle 12 at a rate of about one per second may be sprayed with resin for a period as short as 0.5 second or even 0.03 second or less. the spray period is determined by the reciprocating mechanism 14 comprising a pneumatic or hydraulic cylinder 15 and arms 16 and 17 which, in an up position, places nozzle 12 directly adjacent the open end of container 13 and which, in a down position (illustrated by the dotted lines), places nozzle 12 directly at the mouth of a receiver 18 in which there is a slight negative pressure due to a blower 19 which conveys the collected resin to a recycle receptacle or directly back to powder feeder 10. The recycle collection apparatus permits the continuous, uninterrupted feeding of resin to nozzle 12 and the intermittent spraying of containers.

It is generally preferred to revolve the container about its central, longitudinal axis for about two revolutions during the time it is being sprayed. Because of the time available for spraying, it is generally required that the container rotate from about 500 to about 5000 revolutions per minute with speeds of about 1000 to about 2500 revolutions per minute being typical.

Figure 7:
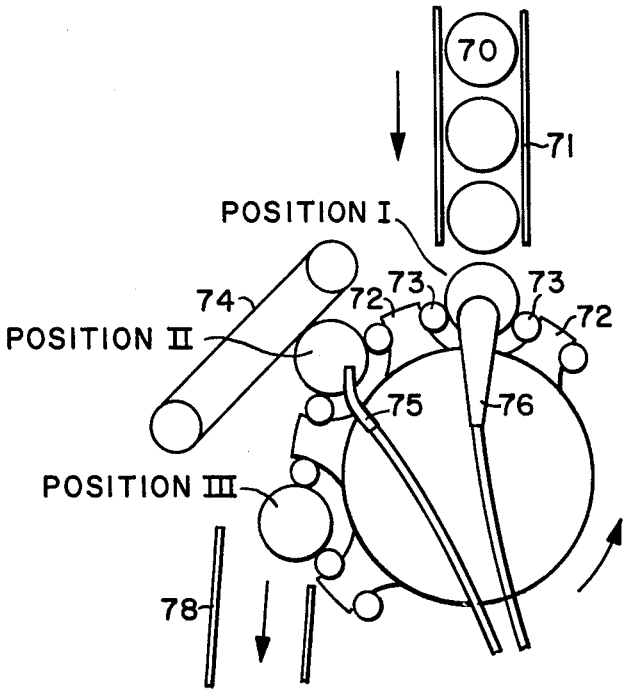
FIG. 7 is an elevational view of a commercial container coating apparatus having a preheat station and a spraying station.

A preferred embodiment for practicing the instant invention is illustrated in FIG. 7. As heretofore mentioned, a commercial can coating operation coats at an optimum rate of 250 to 300 cans per minute, although a can line may be operated as slow as 180 cans per minute. The significance of these rates becomes apparent upon examination of the preferred embodiment.

In FIG. 7 cylindrical containers (cans), which in the preferred instance are two-piece containers, i.e., cans having one closed end, are dropped through an elevator 71 into a cradle formed by a pair of lugs 72 having rollers 73 thereon. The lugs 72 are attached to or are part of a starwheel which rotates about a central axis to transport the containers from the feed elevator 71 to the discharge elevator 74. The containers proceed clockwise in the apparatus illustrated in FIG. 7 from a preheating station (Position I) to a spray station (Position II) to a discharge station (Position III).

As is apparent from the structure of the starwheel, a container resides in Position I and II for exactly the same length of time. Thus, the number of containers which can be coated per minute is limited by the time required at any single position. Because of this, several characteristics of the instant process become important, such as the short period of time required for either preheating or spraying and the ability of the preheating step and the spraying step to be substantially synchronized; i.e., no single step of the process requires substantially more time than any other step.

In Position II the container is rotated at a speed of at least about 500 rpm by means of belt 74 and wheel 75. The container begins to rotate in Position I, although it may not reach maximum rotational velocity until it reaches Position II. Preferably, the container is rotated at the same rotational velocity during preheating as during spraying inasmuch as the turbulence created by rotation facilitates heat transfer. A slender, cylindrical container 70 drops from feed elevator 71 to a preheating station (Position I) where the container is heated by a plasma arc device 76 for a short period, e.g., from about 200 to 300 milliseconds, to a temperature in excess of 225° F, and preferably in excess of 300° F.

The container is then quickly advanced from Position I to Position II by counterclockwise rotation of the starwheel. Finely divided resin particles are uniformly sprayed into the container from a spray nozzle 77 by a carrier gas. At a rotational speed of 500 rpm the container rotates about three rpm during a period of 300 milliseconds. The rotational velocity of the container can be regulated between about 500 and 1800 rpm on commercially available starwheels. A minimum of two revolutions of the container is preferred during the period resin is being sprayed into the container. The resin particles, preferably of a size less than 100 microns, adhere to the container interior in a uniformly distributed manner. The container remains in Position II the same length of time as in Position I.

From Position II the container advances to Position III, where the container discharges into discharge elevator 18. At position III the coating on the container interior is not fully matured if the preheat temperature has been in the lower range, i.e., about 225° F to about 300° F, which means that it is not:

1. a fully cured film, if a thermosetting resin was used, or
2. a fully developed coating, if a thermoplastic resin was used.

For either thermoset or thermoplastic resins, the film produced must be ultimately fully continuous, impermeable, and preferably of a substantially uniform thickness not exceeding about 0.5 mil. Upon initial contact of the resin particles with the preheated substrate heated at about 225° F to about 300° F, a continuous film which is of uneven thickness is formed. The temperature of the container is above the softening point of the resin particles but not above the melting point. (The term "melting point" is more applicable to the low molecular weight thermosettable resins than to the high molecular weight thermoplastic resins for which a comparable temperature is the "flow point".) The resin particles at the lower preheat temperatures are sufficiently softened that a substantially continuous film, which is of uneven thickness, is formed. The coating formed at the lower temperatures, e.g., 225° F to 250° F, will generally pass the copper sulfate test but will not pass the boiling water or Enamel-Rater tests without further processing. A coating formed at low temperatures can be rendered fully matured by postheating at elevated temperatures for a brief period, e.g., 300 milliseconds before a plasma arc device, to elevate the temperature to 425° F to 500° F or by immediately transferring to an oven to be heated at 450° F for a few minutes.

Preheating the container to temperatures of above about 250° F enables the formation of a continuous film which is substantially uniform in thickness, provided the spray technique is capable of applying such films. Thus, such a film, if the resin is a thermosettable one, requires only a very brief postheating at elevated temperatures to affect curing of the film.

Preheating the container to temperatures in excess of about 350° F and preferably above about 425° F permits application of films which are continuous and will fully mature without addition of energy if the thermal energy of the container is conserved. The storage of enough thermal energy in the container to mature fully the coating applied thereto is a unique feature of the instant invention. In the instant process this is achievable even though the preheating and spraying operations are conducted in an environment at ambient temperatures because of the rapid heating to the desired temperature, the rapid transfer of the container from the preheat station to the spray station, the rapid spraying of the conainer while avoiding conditions, e.g., excess carrier gas, which tend to cool the container, and rapid transfer of the container to a heat conservation zone.

Figure 9:
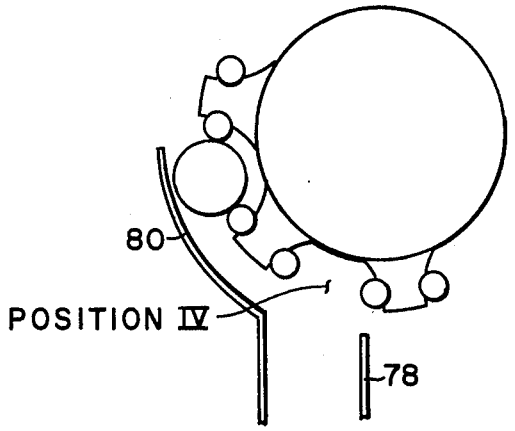
FIG. 9 is a partial elevational view illustrating a modification to the apparatus of FIG. 7 to provide a post-heating station.

As illustrated in FIG. 9, a curved retainer band 80 may be positioned alongside the starwheel adjacent Position III to retain the container at Position III for the same period it experienced in Positions I and II. The container is then discharged at Position IV into discharge elevator 78 which has been displaced to a position underneath Position IV. This modification of the starwheel assembly permits postheating of the container in Position III for a period sufficient at a predetermined temperature to cause the coating to mature. A plasma arc device of the type used to preheat is preferred to accomplish the postheating because of its rapid heating effect. The degree of postheating required depends upon preheat temperatures and resin characteristics.

When preheating is below 300° F, or even below about 350° F, postheating may be delayed for prolonged periods without adversely affecting the coatings upon eventual cure. When preheating temperatures of 300° F or above are used in conjunction with typical thermosetting resins, it becomes important to raise the temperature of the resin to its curing point, usually 400° F or more, substantially immediately, ideally within about 3 seconds, following the spray interval. This procedure is especially important when the metal surface temperature of the container at the commencement of the spray interval is about 350° F or higher.

A typical thermoset resin, for example, one having a softening point of about 120° F to about 150° F, a "melting point" of about 300° F to about 350° F and a curing temperature of about 350° F to about 400° F, requires postheating when the container is preheated to a temperature of only 150° F to about 250° F, and even as high as 300° F because some cooling occurs between Positions I and III so that the temperature of the resin never reaches its curing point (or flow point for a thermoplastic resin). However, with such resins it has been determined that preheating the container to temperatures greater than 425° F, and preferably above 450° F, but not in excess of 525° F for aluminum containers, is sufficient input of thermal energy to cause the resin particles to adhere, to flow immediately into a continuous, pore-free film of substantially uniform thickness and to cure if thermal energy losses, e.g., convection and radiation losses, are substantially minimized. Thermal energy loss can be prevented by supplying thermal energy as fast as it is lost, e.g., a mild postheat, or by conveying the container immediately after spraying to an insulated conveyor whereby heat losses are minimized.

In FIG. 7, a container preheated to a temperature of 425° F or greater in Position I is conveyed to Position II for spraying and is then discharged at Position III into the discharge elevator. Insulating elevator 78 and a portion of the conveyor system following thereafter for a distance sufficient to maintain the container temperatue above 350° for a period of about 1 to 2 minutes. At a container rate of 250 containers per minute and a container diameter of 2 inches, a single line conveyor insulated for a distance of about 40 feet enables the containers to be conveyed in an insulated environment for about 1 minute.

A significant energy savings is realized through conservation of the preheat energy to mature fully the resin film. Although the mass of metal containers, particularly aluminum containers is small in relation to area, the preheating step with a plasma arc generated flame has been found effective to produce a container with a fully matured film on the container interior without requiring additional heat. A further significant advantage of the instant invention is that the preheating step, spraying step and postheating step, if desired or required, can be accomplished in such a very confined space in such a short time that substantially no thermal energy imparted to the container is lost to the environment.

Figure 8:
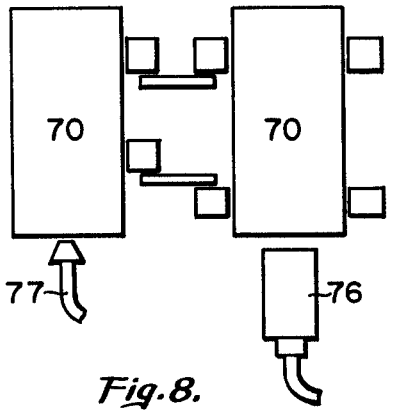
FIG. 8 is a plan view of the apparatus of FIG. 7 illustrating the juxtaposition of containers in the preheat and spraying stations.

Although advantages exist for preheating or postheating containers with a plasma arc device such as illustated in FIGS. 7 through 9, it is to be understood that other heating techniques are effective for preheating and/or postheating containers within the practice of the instant invention. Hot air ovens, infrared heaters and the like may be employed to heat containers. In using other sources of thermal energy, care is to be exercised to provide a heated container having a substantially uniform temperature. Any heating device which heats on portion of the container above its metallurgical limit and fails to heat another portion of the container above the minimum temperature desired is to be avoided.

EXAMPLE I

Cylindrical containers having one open end and one closed end were coated with a thermoset epoxy coating. Fine particles of an epoxy resin, Epon 1004, including an appropriate quantity of dicyanamide (approximately 6%), having an average particle size of about 20 microns were introduced into a powder feeder having the capability of feeding powder at the rate of about one gram per minute to about 150 grams per minute at a substantially constant rate.

Fine resin particles were conveyed at a substantially uniform rate of about 0.2 grams per minute by an inert gas at a rate of about 20 cubic feet per hour. The resin was conveyed through a ⅛ inch plastic tube. Resin was introduced from the tube into cylindrical containers which had been preheated to between 150° F and 200° F. Both stationary and rotated containers were coated. The resin was sufficiently melted by contact with the container interior to adhere thereto. The containers were rotated at a speed of about 200 rpm. The rotated containers had a more uniform dispersion of resin adhered to the interior surface.

The resinous coating was not continuous as applied although an average resin distribution of about 10 milligrams per square inch was achieved.

A cured, continuous coating was obtained by postheating the container at a temperature of about 425° F for about 2 minutes. The rotated containers had a more uniform film thickness.

The resin was fed continuously by the powder feeder. The powder was directed into a single container for about 0.2 seconds.

EXAMPLE II

Cylindrical containers having one open end and one closed end were coated with a thermoset epoxy resin, Epon 1004 with 6% dicyanamide catalyst.

Fine particles having a maximum particle size of less than about 100 microns and an average particle size of about 20 microns were fed from a powder feeder device to a pulsing device having the capability of feeding predetermined pulses of resin in quantities from about 0.2 grams per minute to about 5.0 grams per minute over a pulse period of from about 1/20 second to about 1 second.

A container having an internal area of about 35 square inches was heated to about 200° F. A resin pulse of about 0.4 grams was sprayed into the container in an inert gas stream at a velocity of about 1000 to 3000 feet per minute for a period of a few hundred milliseconds.

A continuous coating of resin particles adhered to the interior surface of the container.

A second container rotated at about 200 rpm was coated in a similar manner. A continuous coating of resin particles adhered to the interior surface of the container.

Both containers were postheated at 425° F for a period of about 2 minutes. A cured, thermoset film resulted in each instance. The container which had been rotated had a significantly more uniform coating.

Both containers were subjected to an Enamel-Rater test. The coatings exhibited conductivities as follows:

Stationary Container — 75 ma
Rotated Container — 12 ma

EXAMPLE III

A slender, cylindrical beer container having one end thereon was coated with a thin, resinous coating. The container, approximately 5¼ inches in length by about 2½ inches in diameter, had an interior area of about 43 square inches.

The container was placed in an apparatus similar to FIG. 2 wherein Nozzle No. 1 was located about one inch from the mouth of the container and at an angle of about 10° from the longitudinal axis of the container. The spray from Nozzle No. 1 was directed at a portion of the container side wall. Nozzle No. 2 was located about one-half inch from the mouth of the container and an angle of 3° from the longitudinal axis of the container. The spray from Nozzle No. 2 was directed to contact the moat and about one-half the domed area of the bottom of the container opposite the spray nozzle.

Each nozzle was connected to a resin pulsing device of the type described in copending application Ser. No. 492,498 wherein a resin/gas mixture could be provided from the pulsator to each nozzle for a predetermined duration of about 50 milliseconds to about 300 milliseconds. A constant amount of resin may be provided by the pulsator regardless of the duration of the spray period. A chamber of different volume can be placed in the pulsator to change the quantity of resin provided during a spray period.

The volume and velocity of gas carrying the resin may be increased or decreased by increasing or decreasing the pressure of the gas provided to the pulsator.

Powdered resin was placed in each hopper of a pulsator. The powder was a thermosettable epoxy resin, Epon 1004, with 6% dicyanamide catalyst, having a particle size range from about 10 microns to about 100 microns with an average particle size of about 30 microns.

A two-piece aluminum beer container (Container No. 1), having an interior area of about 43 square inches, was heated to about 150° F. The container was placed in front of spray nozzles Nos. 1 and 2 as illustrated in FIG. 1. The container was not rotated. The carrier gas pressure was set at 90 psi gauge. Two 80 millisecond bursts of gas and resin were directed into the container. The resin was sprayed first from Nozzle No. 1 and about 30 milliseconds later, resin was sprayed from Nozzle No. 2. A total of about 700 milligrams of resin was sprayed, of which only about 350 milligrams adhered to the container interior. Large areas of the container were bare even after heating the container at 425° F for a period sufficient to cause film continuity on certain parts of the container. The coating was unacceptable for any purpose.

A two-piece aluminum beer container (Container No. 2) having an interior area of about 43 square inches was heated to about 150° F. the container was sprayed in the same manner as Container No. 1 just described except that the container was rotated at a speed of about 500 rpm. A discontinuous coating was formed which became continuous and cured upon postheating at 425° F for about three minutes. A total film weight of about 400 milligrams was present. The coating exhibited an acceptable film conductivity, less than 75 milliamps, when tested in an Enamel-Rater.

A third container (Container No. 3) was sprayed in the same manner as Container No. 2 except that the container was rotated at about 1800 rpm after having been preheated to 425° F. A continuous film having a total weight of about 400 milligrams of very uniform distribution was immediately formed upon contact of the resin particles with the container. The coating was at least partially cured and upon postheating at 425° F for 60 seconds, the coating was fully cured and exhibited a film conductivity of only three milliamps when tested in an Enamel-Rater.

A fourth container (Container No. 4) was sprayed in the same manner as Container No. 3 except that the container was preheated to about 500° F. A continuous film having a total weight of about 400 milligrams of very uniform distribution was immediately formed upon contact of the resin particles with the container. The container was at least partially cured and upon being insulated in an insulated box having a temperature of about 400° F, the coating was fully cured and exhibited a film conductivity of only three milliamps when tested in an Enamel-Rater.

In the description of the instant invention, both film weights per unit area and film thicknesses have been referred to. The following table provides an equivalency guide between these means of identifying film thickness and provides an equivalent weight for a 12 ounce beer container having an internal surface area of 43 square inches.

| Film Weight in Milligrams | | Film Thickness in Mils |
|---|---|---|
| 12 Ounce Container | Per Square Inch | |
| 860 | 20 | 1 |
| 430 | 10 | 0.5 |
| 215 | 5 | 0.25 |
| 107 | 2.5 | 0.125 |
| 86 | 2.0 | 0.10 |

A particularly preferred technique for coating containers according to the instant invention comprises use of a pair of nozzles, as in FIG. 3, wherein the nozzles are angled away from the longitudinal axis of the container and each located at an angle of about three degrees to about seven degrees from the central longitudinal axis of the container so that the spray pattern from each diverge (rather than converge, as illustrated in FIG. 3), and wherein the nozzles are located at about one to about 2 inches appart and preferably from about 1.5 to about 1.7 inches. Preferred distance of the nozzles from container mouth is from about 0.03 to about 0.5 inches. The spray pattern emanating from each nozzle is preferably a fan or cone shape having an included angle at the nozzle of about 40 to 45°. Ideally, the nozzles are discharged simultaneously.

Conductivity Determination

The film conductivity (Enamel-Rater) test employed in evaluating container coating integrity involves impressing a twelve volt constant voltage upon an electroyltic cell having as one electrode the container body with a stainless steel electrode immersed in an aqueous electrolyte, preferably a 10% sodium chloride solution. Although other salts such as potassium chloride, sodium carbonate and the like at concentrations of about 5 to 35 percent may be employed. The electrolyte occupies most of the container volume.

The purpose of the film conductivity test is to predict migration of iron or aluminum ions from the container into the contents of the container. It is estimated that a twelve ounce aluminum beer container having a film conductivity of 75 milliamps would experience a migration of about 150 to 200 parts per million of aluminum ions through the coating and into the beer during a storage period of about 3 months.

A higher film conductivity (lesser film integrity) can be tolerated for beer containers than for soft drink containers because of the greater acidity of soft drinks. For example, a film conductivity of 75 milliamps is generally regarded as acceptable for beer containers while a 10 milliamp conductivity is considered as upper limit for soft drink containers. The tolerable film conductivity or film integrity may vary if the storage time of the container with contents is known to be short; for example, a container whose contents are used within one month after filling may be acceptable even though it has a film conductivity three times as great as a filled container which has a storage life of three months.

The invention as presently envisioned contemplates coating either a two-piece container (one with an integral closed end) or a three-piece container (one with both ends open). In the second instance, a closure for one end, e.g., a spray plate, is provided to seal one end of the container during the spray interval. The interior surface of the container is then heated (preheat) to a temperature above the softening point of the resin to be used. Useful preheat temperature may be as low as 150° F, but normally exceed 225° F, and preheat temperatures in excess of 300° F are generally preferred. The container is rotated during the spray interval, preferably at least two revolutions. A predetermined quantity of resin is pheumatically conveyed into the interior of the container during the spray interval through the open end of the container, preferably through one or more nozzles located outside the container under conditions wherein:

a. The resin is in powder form and has a maximum particle diameter of less than about 20 microns. Preferably the resin particles are approximately round (or at least rounded) and the average diameter of the particles is less than about 8 microns.
b. The particle velocity of the resin is sufficient to penetrate through the static air barrier adjacent the interior surface of the container.
c. The resin is ideally conveyed at an approximately uniform rate throughout the spray interval.

Following the spray interval, the thus-applied resin is heated (postheating) to cure it into a substantially uniform, solvent-free, ultra-thin coating. Ideally, the spray interval is less than about 150 milliseconds. Moreover, it is highly preferred to correlate the resin composition with the preheat temperature so that the individual particles adhere to the surface, melt, flow, gel and partially cure, all within a period of less than about 150 milliseconds. Typical useful thermoset epoxy resins have softening points of between about 120° F and about 150° F, and useful postheat temperatures for such resins usually exceed 350° F, e.g., 400° F or more. Of course, other parameters may be preferred when thermoplastic resins are used. The resin is often introduced through a plurality of nozzles and/or in a plurality of pulsed quanta.

The procedures described herein are intended for adaptation to a commercial can line which includes a mechanism for rotating the cans around their longitudinal axes. Each can of a series is mounted in the mechanism in turn and the spray intervals are synchronized to begin when each thus-mounted can has rotated a predetermined amount, e.g., about one-half revolution. The spray intervals are spaced to permit the ejection of a coated container from the spinning mechanism and the delivery of the next container of the series to the mechanism.

The methods of this invention are useful to producing a broad class of coated metal containers heretofore unknown within the art. The useful substrate (interior surface) may be either light or heavy gauge aluminum, tin plate, convential container quality steel, or tin-free steel, as well as any other metal useful for producing a container of the type commonly referred to as a "tin can". This substrate is coated with a substantially uniform, continuous, solvent-free, thin layer of resinous material. The resulting containers have broad utility, particularly for the storage of food and beverages.

Although the invention has been described by reference to specific embodiments, it is not intended to be limited solely thereto but to include all the modifications and variations falling within the scope of the appended claims.

We claim:

1. A process for coating the entire interior surface of a cylindrical type container having one open end and one closed end with an ultra-thin polymeric coating comprising:

a. preheating said container to a temperature of at least about 150° F;
b. spraying into the interior of said container from a location outside of said container a quantum of finely divided resin particles having maximum individual particle diameters of less than about 20 microns and a softening point less than about 150° F sufficient to coat the container interior with a continuous film, said resin entrained in a gas stream traveling at a velocity sufficient to create substantial turbulence in said container; and
c. rotating said container rapidly to create a vortex therein and to cause said container to rotate at least two revolutions during spraying of the resin particles.

2. The process of claim 1 wherein said coated container is postheated at a temperature sufficiently above the melting temperature of said resin for a period sufficient to cause said resin of flow into a thin, continuous, substantially pore-free coating.

3. The process of claim 1 wherein said resin is a thermosetting resin.

4. The process of claim 3 wherein said coated container is postheated at a temperature sufficiently above the curing temperature of said resin for a period sufficient to cause said resin to flow into a thin, continuous, substantially pore-free, cured coating.

5. The process of claim 1 wherein said container is preheated to a temperature of at least 225° F.

6. The process of claim 1 wherein said resin is sprayed at a velocity of at least about 200 feet per minute.

7. The process of claim 1 wherein the gas to resin ratio is less than about two to one on a volume basis.

8. The process of claim 1 wherein the gas to resin ratio is less than about one to two on a volume basis.

9. The process of claim 1 wherein said resin quantity is sufficient to coat said container interior with a continuous film having a thickness of about 0.05 to about 0.5 mil.

10. The process of claim 1 wherein said container is rotated at a speed of about 500 to about 5000 revolutions per minute.

11. The process of claim 10 wherein said resin is sprayed into said container for a minimum period of about 20 milliseconds at 5000 revolutions per minute to about 200 milliseconds at 500 revolutions per minute.

12. The process of claim 10 wherein said container is rotated at a speed of about 1000 revolutions per minute to about 2500 revolutions per minute.

13. The process of claim 12 wherein said resin is sprayed into said container for a minimum period of about 100 milliseconds at 1000 revolutions per minute to about 40 milliseconds at 2500 revolutions per minute.

14. Method for spraying a slender container having one closed end and one open end with resinous solid particles comprising:

a. preheating said container to a substantially uniform temperature above the softening point of the resin, b. introducing a mixture of carrier gas and very fine resin particles having maximum individual particle diameters of less than about 20 microns of a predetermined quantity over a predetermined period in excess of about 30 milliseconds wherein the rate of resin introduction is substantially uniform over the period during which said resin particles are being introduced, said resin particles adhering to said container interior as a continuous film, and c. maturing said resinous coating to form an adherent, solvent-free, ultra thin coating having a substantially uniform film thickness over the whole container interior.

15. A method for coating the interior of a cylindrical metal container with a resin during a predetermined short spray interval comprising:

a. providing a closure for one end of said container so that it has a single open end;

b. heating the interior surface of the container to a temperature above the softening point of the resin;

c. rotating said container around its longitudinal axis at least two revolutions during said spray interval; and d. pneumatically conveying a predetermined quantity of the resin into the interior of said container through its open end during said spray interval under conditions wherein:

1. the resin is in powder form and has a maximum particle diameter of less than about 20 microns;
2. the particle velocity of the resin is sufficient to penetrate through the static air barrier adjacent the interior surface of the container; and
3. the resin is conveyed at an approximately uniform rate throughout this spray interval, and thereafter e. heating the thus-applied resin to cure it into a solvent free, ultra-thin coating over substantially the entire interior surface of the container.

16. A method according to claim 15 wherein said container is a two-piece container and said closure is the integral closed end of said container.

17. A method according to claim 15 wherein said container is a three-piece container, and said closure comprises baffle means position to seal one end of the conainer during the spray interval.

18. A method according to claim 15 wherein said resin is sprayed into said container through a nozzle located outside said container.

19. A method according to claim 18 wherein the spary interval is less than about 150 milliseconds.

20. A method according to claim 18 wherein the resin composition is correlated to the temperature to which the interior surface is heated prior to the spray interval so that the individual particles adhere to said surface, melt, flow, gel and partially cure within a period of less than about 150 milliseconds.

21. A method according to claim 18 wherein the individual resin particles are approximately round.

22. A method according to claim 21 wherein the average diameter of the resin particles is less than about 8 microns.

23. A method according to claim 18 wherein:

a. the interior surface of said containers is heated to at least 150° F prior to the spray interval;

b. the thus-applied resin is heated to at least about 350° F following the spray interval; and c. the resin is a thermo-set epoxy resin evidencing a softening point of between about 120° and about 150° F.

24. A method according to claim 23 wherein the interior surface of the container is heated to at least about 300° F prior to the spray interval and the resin is raised to its curing temperature within about 3 seconds following the spray interval.

25. A method according to claim 18 wherein the resin is a thermoplastic material.

26. A method according to claim 18 wherein the resin is introduced during said spray period through a plurality of pulsed quanta.

27. A method according to claim 15 adapted for sequentially coating a series of containers, whereby each said container is in turn mounted in a mechanism for rotating it and a series of spray intervals is synchronized to begin when each thus-mounted container has completed about one-half revolution, said intervals being spaced to permit the ejection of a coated container and the delivery of the next container of the series to said mechanism.

* * * * *

UNITED STATES PATENT AND TRADEMARK OFFICE

CERTIFICATE OF CORRECTION

PATENT NO. : 4,025,664
DATED : May 24, 1977
INVENTOR(S) : Gene Gerek; Robert G. Coucher It is certified that error appears in the above-identified patent and that said Letters Patent are hereby corrected as shown below:

Column 5, line 50, change "conainer" to ---container---;

Column 5, line 51, change "sine" to ---since---;

Column 5, line 56, change "it" to ---is---;

Column 6, line 26, change "temperatue" to ---temperature---;

Column 7, line 49, change "copening" to ---copending---;

Column 16, line 8, change "illustated" to ---illustrated---;

Column 16, line 16, change "on" to ---one---;

Column 19, line 28, change "as" to ---an---;

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*